US010001721B2

(12) United States Patent
Naito et al.

(10) Patent No.: US 10,001,721 B2
(45) Date of Patent: Jun. 19, 2018

(54) IMAGE FORMING APPARATUS

(71) Applicant: CANON KABUSHIKI KAISHA, Tokyo (JP)

(72) Inventors: Norihito Naito, Numazu (JP); Masataka Mochizuki, Mishima (JP); Takayoshi Kihara, Mishima (JP); Kosuke Ikada, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/670,226

(22) Filed: Aug. 7, 2017

(65) Prior Publication Data

US 2018/0046109 A1 Feb. 15, 2018

(30) Foreign Application Priority Data

Aug. 10, 2016 (JP) ..... 2016-157878

(51) Int. Cl.
*G03G 15/043* (2006.01)

(52) U.S. Cl.
CPC ..... *G03G 15/043* (2013.01)

(58) Field of Classification Search
CPC ..... G03G 15/043
See application file for complete search history.

(56) References Cited

U.S. PATENT DOCUMENTS 5,315,351 A * 5/1994 Matsushiro ..... G03G 15/043 399/49
2003/0058325 A1* 3/2003 Fukui ..... G03G 15/326 347/133
2009/0016752 A1* 1/2009 Hirano ..... G03G 15/326 399/50
2015/0130886 A1* 5/2015 Yaguchi ..... G03G 15/043 347/224

FOREIGN PATENT DOCUMENTS

| | | | |
|---|---|---|---|
| JP | 8-95321 | A | 4/1996 |
| JP | 2000181154 | A | 6/2000 |
| JP | 2003295540 | A | 10/2003 |
| JP | 2006243357 | A | 9/2006 |
| JP | 2011118234 | A | 6/2011 |
| JP | 2011186037 | A | 9/2011 |
| JP | 2012013881 | A | 1/2012 |
| JP | 2013217986 | A | 10/2013 |
| JP | 2015158602 | A | 9/2015 |

* cited by examiner

*Primary Examiner* — Clayton E LaBalle
*Assistant Examiner* — Jas Sanghera
(74) *Attorney, Agent, or Firm* — Canon U.S.A., Inc. IP Division

(57) ABSTRACT

An image forming apparatus includes a control unit configured to change, to a light quantity different from a plurality of reference light quantities, a light quantity per unit area of a surface of an electrical charge retention layer of a photosensitive member when an exposure unit exposes the surface in correspondence with a plurality of gradation levels, based on a plurality of exposure potentials corresponding to the plurality of gradation levels which is acquired by exposing with the exposure unit the surface with each of the plurality of reference light quantities corresponding to the plurality of gradation levels, and measuring with the measurement unit the plurality of exposure potentials of the photosensitive member which is formed by the exposure with the plurality of reference light quantities.

11 Claims, 16 Drawing Sheets

FIG.13

| PATTERN | 0 | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| LIGHT QUANTITY | 0.0 | 0.3 | 0.6 | 0.9 | 1.3 | 1.6 | 1.9 | 2.2 | 2.5 | 2.8 | 3.1 | 3.4 | 3.8 | 4.1 | 4.4 | 4.7 | 5.0 |

UNIT OF LIGHT QUANTITY: [mJ/m$^2$]

FIG.14

| FILM THICKNESS | GRADATION LEVEL | | |
|---|---|---|---|
| | A | B | C |
| 15 | 3 | 6 | 10 |
| 5 | 6 | 10 | 13 |

IMAGE FORMING APPARATUS

BACKGROUND OF THE INVENTION

Field of the Invention

The present invention relates to an image forming apparatus using an electrophotographic printing method.

Description of the Related Art

An image forming apparatus configured to form images on recording materials by using an electrophotographic printing method, such as a laser printer, includes a photosensitive member for forming an electrostatic latent image, visualizing (developing) the electrostatic latent image with a developing agent, and transferring the visualized (developed) image onto a recording material, etc. The photosensitive member has an electric characteristic that changes depending on a use environment and how it is used. Especially the thickness of an electrical charge retention layer configured to retain an electrostatic potential is changed with use. Further, a discharge current value and sensitivity of the photosensitive member change with a change in temperature and humidity in an environment, etc. The changes cause a change in image density to change the appearance of an output image, especially an image with various density regions, such as a photographic image.

In a known method for maintaining a uniform image density, a surface potentiometer for detecting potential information about a photosensitive member is included in an image forming apparatus, and potential fluctuations with use or due to environmental changes, etc. are detected and corrected to maintain a uniform image density (Japanese Patent Application Laid-Open No. 2000-181154). Further, methods for detecting a surface potential state are discussed in which a discharge start voltage is detected according to Paschen's Law instead of using a direct measurement method such as a method using a surface potentiometer to detect a potential state of a photosensitive member with ease (Japanese Patent Application Laid-Open Nos. 2011-118234 and 2012-13881).

The above-described conventional arrangements are capable of obtaining a surface potential of a target photosensitive member. However, there has arisen a situation where suppression of changes in image quality is difficult. For example, if a coating layer of the photosensitive member is used up to a thickness thereof due to an extended lifetime, not only an exposure potential can change but also an intermediate gradation potential between a charging potential and exposure potential can significantly change. A significant change in an intermediate gradation potential can lead to a change in gradations or, in an arrangement that actively uses intermediate gradation potentials to develop a combination of a plurality of colors as in color images, a change in appearance, color, etc. Further, since the conventional arrangements use a developing agent to detect densities, the developing agent is consumed not only to form images but also for other purposes, so the number of printable sheets can be affected if the detection is performed too frequently.

SUMMARY OF THE INVENTION

The present invention features, among other things, an image forming apparatus capable of suppressing a change in image quality due to a change in gradation characteristics of a photosensitive member associated with environmental changes or use.

According to an aspect of the present invention, an image forming apparatus includes a photosensitive member having an electrical charge retention layer, a charging member configured to electrically charge the photosensitive member, an exposure unit configured to expose a surface of the electrical charge retention layer to form an electrostatic image on the surface, a developing agent bearing member configured to supply a developing agent to the surface to develop the electrostatic image and form a developing agent image, a measurement unit configured to measure an exposure potential of the photosensitive member based on a discharge start voltage, and a control unit configured to control a light quantity per unit area of the surface exposed by the exposure unit, wherein the developing agent image is transferred onto a recording material to form an image on the recording material, and wherein, based on a plurality of exposure potentials corresponding to a plurality of gradation levels which is acquired by exposing with the exposure unit the surface with each of a plurality of reference light quantities corresponding to the plurality of gradation levels, and measuring with the measurement unit the plurality of exposure potentials of the photosensitive member which is formed by the exposure with the plurality of reference light quantities, the control unit changes, to a light quantity different from the reference light quantities, the light quantity per unit area of the surface when the exposure unit exposes the surface in correspondence with the plurality of gradation levels.

Further features of the present invention will become apparent from the following description of example embodiments with reference to the attached drawings.

BRIEF DESCRIPTION OF THE DRAWINGS

FIG. 13 illustrates a correlation between dither patterns and laser light quantities according to the third example embodiment of the present invention.

FIG. 14 illustrates film thicknesses and dither patterns according to the third example embodiment of the present invention.

DESCRIPTION OF THE EMBODIMENTS

Various example embodiments of the present invention will be described in detail below with reference to the drawings. Sizes, materials, shapes, relative positions of components described in the following example embodiments can be appropriately modified or changed depending on individual configurations and various conditions of apparatuses to which aspects of the present invention are applied. In other words, the present invention is in no way limited to the following example embodiments.

[Configuration of Image Forming Apparatus]

Figure 2:
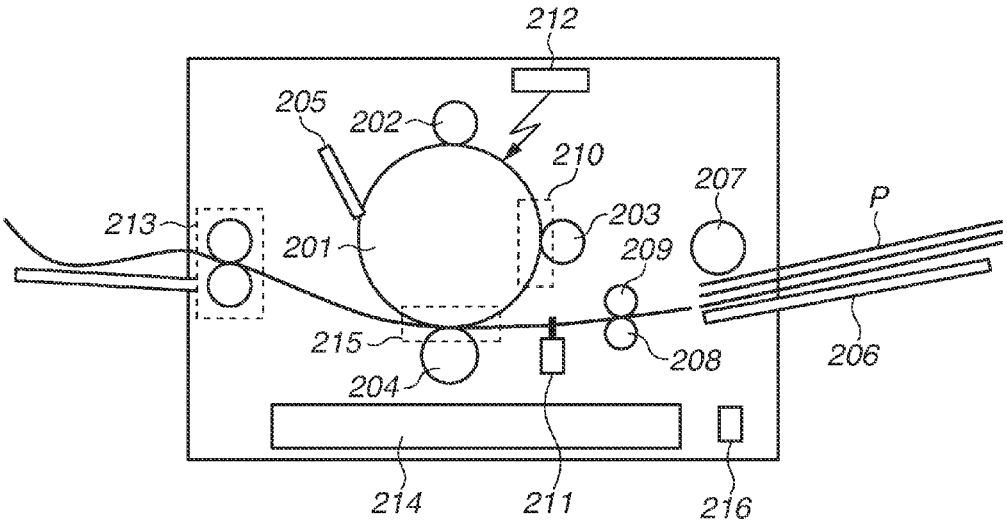
FIG. 2 is a cross sectional view illustrating an image forming apparatus according to an example embodiment of the present invention.
Figure 3:
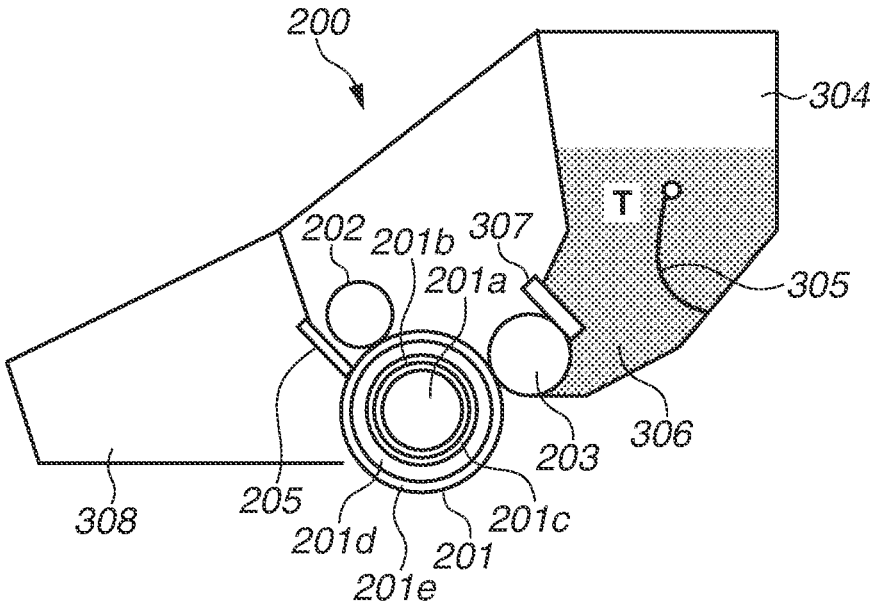
FIG. 3 is a cross sectional view illustrating a process cartridge according to an example embodiment of the present invention.

An image forming apparatus according to a first example embodiment of the present invention will be described below with reference to FIGS. 2 and 3. In the present example embodiment, a case will be described in which aspects of the present invention are applied to a laser beam printer as an image forming apparatus configured to form images on recording materials by using an electrophotographic printing method. The image forming apparatus according to the present example embodiment is configured in such a manner that a process cartridge including a processing unit for forming images is attachable to and detachable from an apparatus main body. FIG. 2 is a schematic cross sectional view schematically illustrating a configuration of the image forming apparatus according to the present example embodiment. FIG. 3 is a schematic cross sectional view schematically illustrating a configuration of the process cartridge.

First, the configuration of the image forming apparatus will be schematically described along a flow of a sheet material P. The image forming apparatus according to the present example embodiment is an image forming apparatus configured to form an image on the sheet material P as a recording material by using an electrophotographic printing method. The sheet material P is conveyed by a sheet feed and conveyance unit to an image forming unit, and a toner image is transferred onto the sheet material P. Then, the sheet material P is conveyed to a fixing unit, and the toner image is fixed to the sheet material P so that the toner image becomes a permanent image. Thereafter, the sheet material P is discharged to a sheet discharge tray.

More specifically, a sheet feeding tray 206 on which the sheet materials P are stacked and stored is attached to a right side surface portion of the image forming apparatus in FIG. 2. The sheet materials P stacked and stored on the sheet feeding tray 206 are sequentially fed from an uppermost sheet material P by a sheet feeding roller 207. The fed sheet material P is conveyed to an image forming unit 215 by a pair of conveyance rollers 208 and 209. A sensor lever 211 that detects the passage of the sheet material P is provided near the image forming unit 215, and the sensor lever 211 detects the passage of the sheet material P. After a predetermined time has elapsed since the detection of the passage of the sheet material P, a laser scanner 212 serving as an exposure unit emits laser light corresponding to image information onto a photosensitive member 201 to form an electrostatic latent image (electrostatic image) is formed on the photosensitive member 201. The electrostatic latent image is developed with toner at a development portion 210 in the process cartridge. The developed image is transferred as an unfixed toner image onto the sheet material P at a transfer nip portion formed by the photosensitive member 201 and a transfer roller 204 pressing against each other. Then, the sheet material P is conveyed to a fixing device 213 as the fixing unit. The sheet material P is passed through the fixing device 213 to undergo a fixing process and is then conveyed and discharged to the outside of the apparatus. An electric equipment unit 214 in FIG. 2 includes a power source unit of the apparatus and a control substrate for controlling the apparatus. The configuration of the electric equipment unit 214 is similar to conventionally-known configurations, so detailed description of the configuration is omitted.

The photosensitive member 201 is rotated clockwise in FIG. 2. A voltage is applied to a charging roller 202 as a charging member to uniformly electrically charge a surface of the photosensitive member 201. The voltage is applied to the charging roller 202 from the electric equipment unit 214 on the apparatus main body side via a charging contact point (not illustrated). Then, the laser scanner 212 irradiates the photosensitive member 201 with laser light corresponding to image information to form an electrostatic latent image on the photosensitive member 201. Then, the electrostatic latent image is developed with toner as a developing agent to visualize the image as a toner image (developing agent image). The charging roller 202 is provided in contact with the photosensitive member 201. In the present example embodiment, the charging roller 202 is driven and rotated by the photosensitive member 201. Further, a development roller 203 as a developing agent bearing member supplies toner to a development region on the photosensitive member 201 at the development portion 210 so that the electrostatic latent image formed on the photosensitive member 201 is developed and visualized.

FIG. 3 illustrates a development unit. Toner T in a toner storage container 304 is sent to a development chamber 306 by rotation of an agitation member 305. Then, while the development roller 203 having a built-in magnet roller (stationary magnet) is rotated, a toner layer is formed on a surface of the development roller 203. A thickness of the toner layer is regulated and a triboelectric charge is applied to the toner layer by a development blade 307. A voltage is applied from the electric equipment unit 214 as a development bias source to the development roller 203 to transfer the toner borne on the development roller 203 to the photosensitive member 201 according to a level of a potential at a latent image formed on the photosensitive member 201, thereby forming a toner image (visualization). The voltage is applied from the electric equipment unit 214 on the apparatus main body side via a development contact point to a development contact point on the process cartridge side and the development roller 203. The development blade 307 regulates the amount of the toner on the peripheral surface of the development roller 203 and also applies a triboelectric charge thereon. After the toner image is transferred onto the sheet material P by the transfer roller 204, residual toner on the photosensitive member 201 is removed by a cleaning unit. Then, the photosensitive member 201 is available for the next image forming process. As the cleaning unit, an elastic cleaning blade 205 provided in contact with the photosensitive member 201 scrapes residual toner on the photosensitive member 201, and brings the scraped toner together into a waste toner container 308.

In the present example embodiment, a process cartridge 200 includes the photosensitive member 201, the charging roller 202, the development roller 203, the elastic cleaning blade 205, the toner storage container 304, the agitation member 305, the development chamber 306, the development blade 307, and the waste toner container 308. In other words, the aforementioned components are integrated in a single housing or a housing divisible into a plurality of units to form the process cartridge 200.

Further, the photosensitive member (photosensitive drum) 201 includes a conductive support member 201*a*, an inhibition layer 201*b*, a photosensitive layer 201*c*, a charge transport layer 201*d*, and an electrical charge retention layer 201*e*, which are layered in this order on a peripheral surface of the conductive support member 201*a* as illustrated in FIG. 3. The conductive support member 201*a* is mainly made of a metal conductive material such as aluminum. The inhibition layer 201*b* formed on a surface of the conductive support member 201*a* inhibits injection of an electrical charge from the conductive support member 201*a*. The photosensitive layer 201*c* generates a pair of electrical charges in response to application of light, and the generated electrical charges are moved through the charge transport layer 201*d* and retained by the electrical charge retention layer 201*e* provided on an uppermost layer.

As to image forming conditions, the rotation speed of the photosensitive member 201 is adjusted to 100 rpm, and the charging roller 202 employs an alternating current (AC) bias in which a direct current (DC) voltage is superimposed on an AC waveform to adjust the charging potential of the photosensitive member 201 to −500 V. Further, the laser light quantity at which the exposure potential of the photosensitive member 201 scanned and exposed by the laser scanner 212 is −100 V is adjusted to 3.0 mJ/m$^2$. Further, since the image density is used for the purpose of description in the present example embodiment, the bias (development bias) applied to the development roller 203 is adjusted to −400 V with respect to the exposure potential of −100 V in such a manner that the image density at the above-described charging potential and the above-described exposure potential is adjusted to 1.5 (with Macbeth RD-917). A difference (development contrast) between the exposure potential and the development bias is adjusted to 300 V. As to an image density expression, an exposure amount per unit area of the photosensitive member 201 is selected based on gradation level information about image data to express the image density. In other words, a plurality of exposures amounts (plurality of laser light quantities) per unit area of the photosensitive member 201 corresponding to a plurality of gradation levels are preset (reference light quantities). In the present example embodiment, the laser light quantity (mJ/m$^2$) is changed using the laser light quantity of 3.0 mJ/m$^2$ at the exposure potential of −100 V of the photosensitive member 201 as a reference to change the exposure amount per unit area of the photosensitive member 201 as described above. Further, the laser light quantity (mJ/m$^2$) is changed by changing the luminance of light emitted from a laser, i.e., a luminance modulation method is used. Specifically, a plurality of laser driving currents of different sizes is selectively applicable to a laser semiconductor. The method for changing the laser light quantity (mJ/m$^2$) is not limited to the luminance modulation method. A method in which a laser driving current application time is changed to change a laser light emission period corresponding to one dot (so-called pulse-width modulation method (PWM)) can be used alone or in combination with the luminance modulation method.

[Conventional Density Correction Method]

A change in sensitivity of a photosensitive member can cause of a density fluctuation that necessitates density correction. Main causes of a change in sensitivity of a photosensitive member are a change in temperature/humidity in a use environment, etc. and a wear change in a use state, etc. In response to a change in a use environment, conventionally, an environment sensor is provided and various conditions, such as a charging bias, development bias, and exposure amount, are changed in such a manner that the development contrast is made constant to obtain a stable density in order to perform printing under suitable conditions for an environment in which the apparatus is located. Further, in response to a wear change in a use state, etc., conventionally, how a photosensitive member is used is measured to predict a wear change rate from a result of the measurement, and various conditions are optimized for the use state to obtain a stable density as in the case of the environmental change. Further, as described above in the section "Description of the Related Art", potential information about a photosensitive member is measured with a surface potentiometer or the like to perform density correction based on accurate potential information.

However, when the variety of use environments increases and an installation space reduction and a lifetime extension are promoted, use of a measurement device such as a surface potentiometer to directly measure potential information about a photosensitive member hinders the installation space reduction and the lifetime extension due to a large installation area of the measurement device. Further, it is found that in a case in which a photosensitive member is used to the utmost, when the correction is performed to make the development contrast constant, a sufficient image density is obtained, but a change in halftone density occurs in intermediate gradation regions such as halftones to change the appearance of an image.

Feature of Present Example Embodiment

Thus, in the present example embodiment, the potential of a latent image on the photosensitive member is measured using a discharge start voltage measurement technique, and not only solid portions corresponding to density portions but also intermediate gradations such as halftones are measured to acquire gradation characteristics. Density changes in halftone regions that are changed depending on a use environment and use state are corrected so that stable halftone images are obtained while an apparatus size reduction is achieved.

Figure 9A:
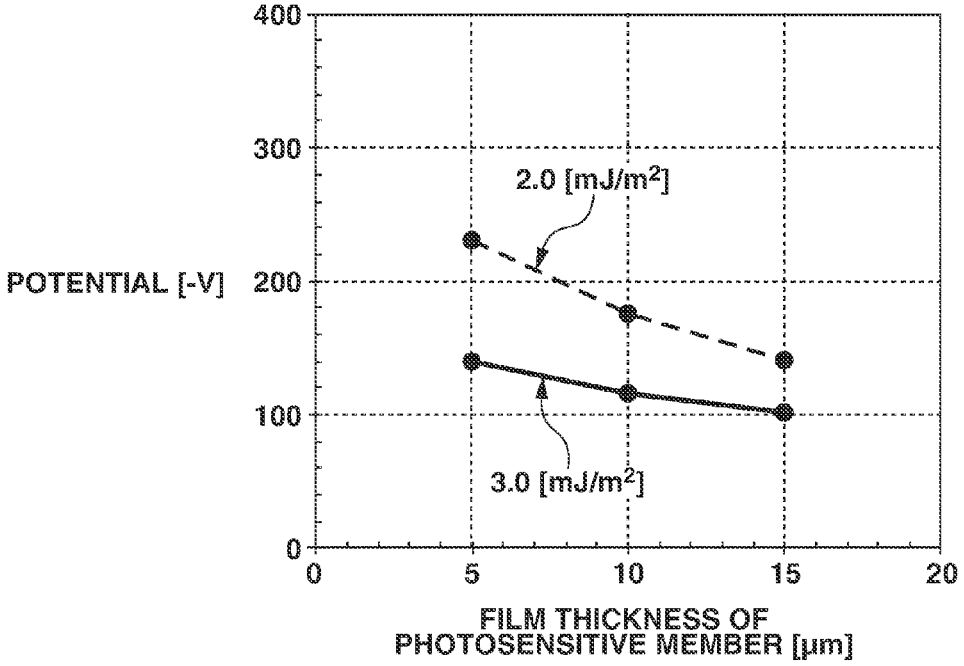
FIGS. 9A and 9B schematically illustrate potential profiles according to an example embodiment of the present invention.
Figure 9B:
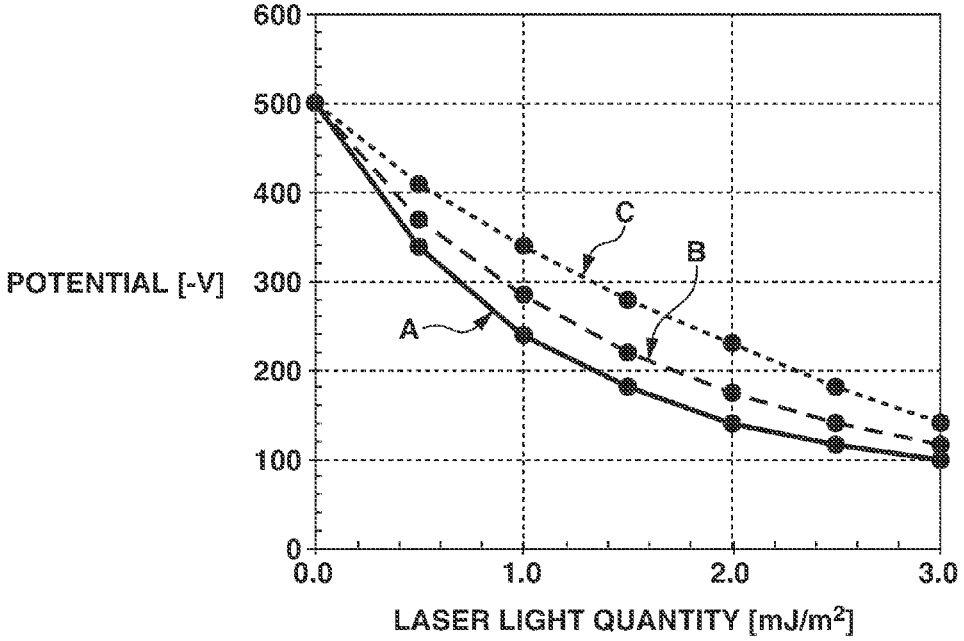

The following describes a change in a photosensitive member that cases a density change, with reference to FIGS. 9A and 9B. FIG. 9A illustrates changes in film thickness of the photosensitive member and changes in exposure potential of the photosensitive member. In FIG. 9A, a horizontal axis denotes the film thickness (layer thickness) of an electrical charge retention layer of the photosensitive member, and a vertical axis denotes the potential of a surface of the photosensitive member during exposure. Conventionally, a lower-limit film thickness for maintaining an image against film thickness fluctuations arising from durability changes is about 10 μm. This is determined based on film thicknesses with which uneven wear and local changes due to small scratches and the like on a surface of a photosensitive member are less likely to appear on an image regardless of the number of printed sheets or how it is used. Further, a solid-line graph illustrates changes in exposure potential in a case of a laser light quantity of 3.0 mJ/m$^2$ used in the present example embodiment, and a broken-line graph illustrates a case of a laser light quantity of 2.0 mJ/m$^2$ used commonly in halftone images and the like.

As to recent electrophotographic apparatuses, highly-accurate components are developed and highly-accurate control of an amount of wear becomes possible, so uneven wear and local changes are less likely to appear on an image, and the film thickness for maintaining image quality is reduced to up to about 5 μm. Conventionally, the film thickness for maintaining image quality is up to about 10 μm, so a fluctuation range with respect to the light quantity of a laser scanner is small in changes in exposure potential, and a significant change in appearance is not likely to occur although there is a slight density change. Further, change ranges for different laser light quantities are compared, but there is no significant difference between the change ranges.

On the other hand, if the drum film thickness is changed to 5 μm, for example, the change range for the laser light quantity of 2.0 mJ/m$^2$ is greater than the change range for the laser light quantity of 3.0 mJ/m$^2$. Thus, even if the development contrast is corrected to obtain a stable density with respect to the laser light quantity of 3.0 mJ/m$^2$, the laser light quantity of 2.0 mJ/m$^2$ may be insufficient, and the appearance of an image can be changed. Specifically, there arises a problem that while a high-density region using the laser light quantity of 3.0 mJ/m is reproduced with a similar density, an intermediate-density region using the laser light quantity of 2.0 mJ/m$^2$ is reproduced with a lower density.

Figure 4:
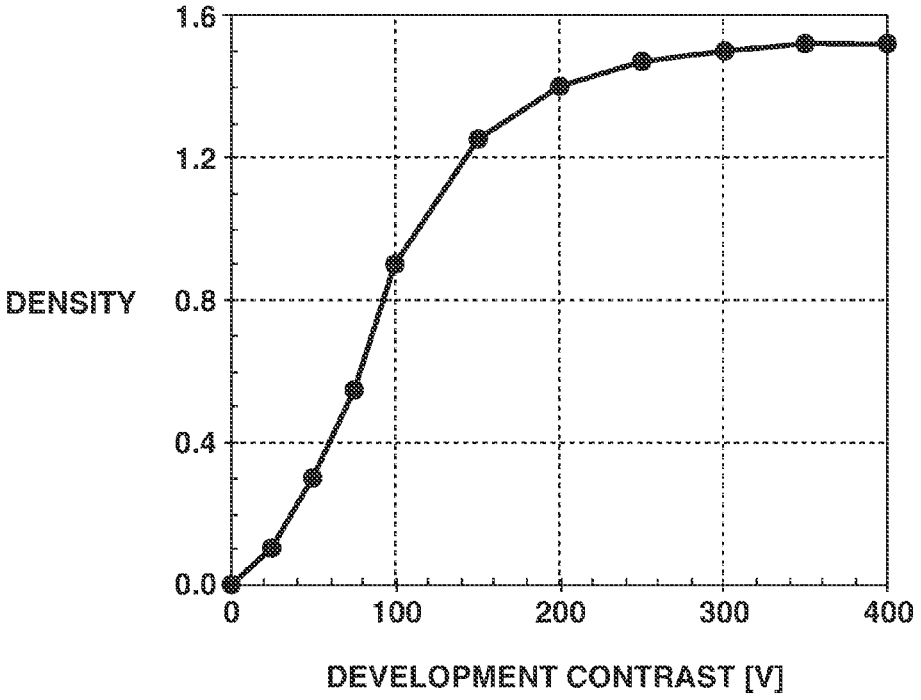
FIG. 4 illustrates a relationship between development contrast and black portion density according to an example embodiment of the present invention.

The following is a further detailed description with reference to FIG. 9B. FIG. 9B illustrates the relationship between laser light quantities and exposure potentials. In FIG. 9B, a line A illustrates a case of a large film thickness of a photosensitive member that is 15 μm, and lines B and C respectively illustrate cases of film thicknesses of 10 μm and 5 μm. From FIG. 9B, it is understood that the range of change in exposure potential of halftone with a small laser light quantity is increased at smaller film thicknesses of the photosensitive member. Further, the development contrast, which is a potential difference between exposure potential and development bias, and image density have a trend illustrated in FIG. 4, and it is understood that every exposure potential should be constant regardless of the use state in order to stabilize an image including halftones. FIG. 4 illustrates the relationship between development contrast and density.

<Exposure Potential Measurement Unit>

Figure 5:
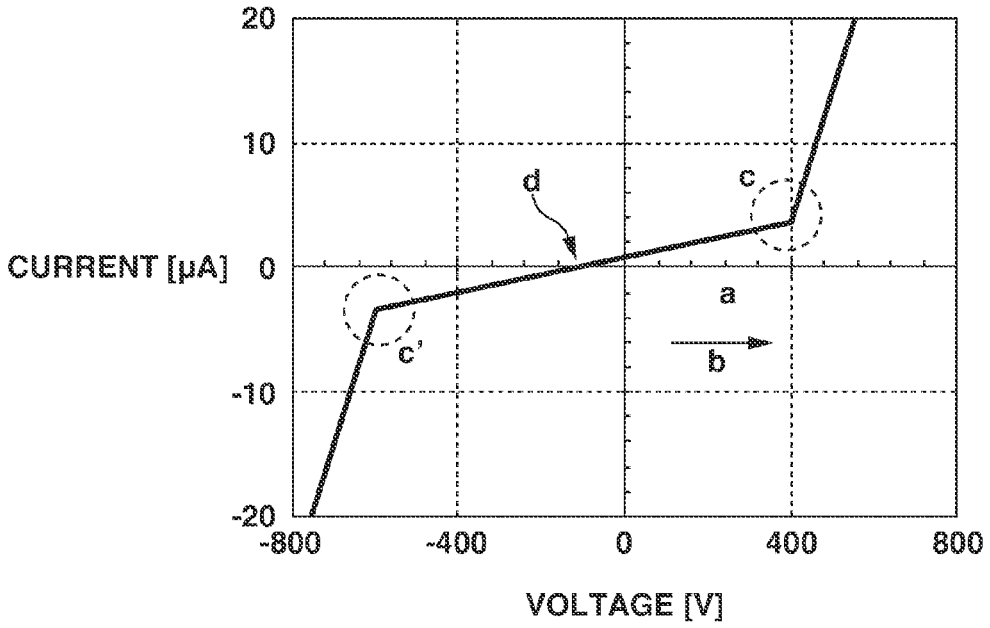
FIG. 5 illustrates aspects of a method of detecting a surface potential of a photosensitive member according to an example embodiment of the present invention.

The following describes an exposure potential measurement unit used in the present example embodiment, with reference to FIG. 5. FIG. 5 illustrates aspects of a method of detecting a surface potential (exposure potential) of the photosensitive member according to the present example embodiment. In the present example embodiment, exposure potential measurement is performed using a transfer roller as a transfer member. The configuration of a circuit for the exposure potential measurement is similar to those of well-known conventional circuits, e.g., configurations discussed in Patent Documents 2 and 3, so detailed description of the configuration is omitted. Laser light is applied to a charging potential (Vd) formed on the photosensitive member by the charging roller to form an exposure potential (Vl). When a portion on which the exposure potential (Vl) is formed arrives at the transfer roller portion, a transfer bias (Tv) is applied to the transfer roller, and a current value (I) of current flowing in the transfer roller at this time is monitored. The transfer bias (Tv) applied to the transfer roller is a DC voltage. The transfer bias (Tv) is sequentially increased (arrow b in FIG. 5) with an expected exposure potential being a starting point (e.g., a). During this process, there arises a point (e.g., c) of transfer bias (Tv') at which the rate of increase in the current value (I) changes. In other words, the voltage at the point is the discharge start voltage which indicates that a discharge current starts flowing in addition to resistance current components flowing between the transfer roller and the photosensitive member. The above-described operation is performed with respect to both polarities of a positive polarity side (+Tv') and a negative polarity side (−Tv') using the expected exposure potential as a reference. Intermediate values (d) between the discharge start voltages (c, c') of the respective polarities acquired in the detection indicate surface potentials of the photosensitive member, which are the exposure potentials (Vl).

<Gradation Characteristics>

Figure 6A:
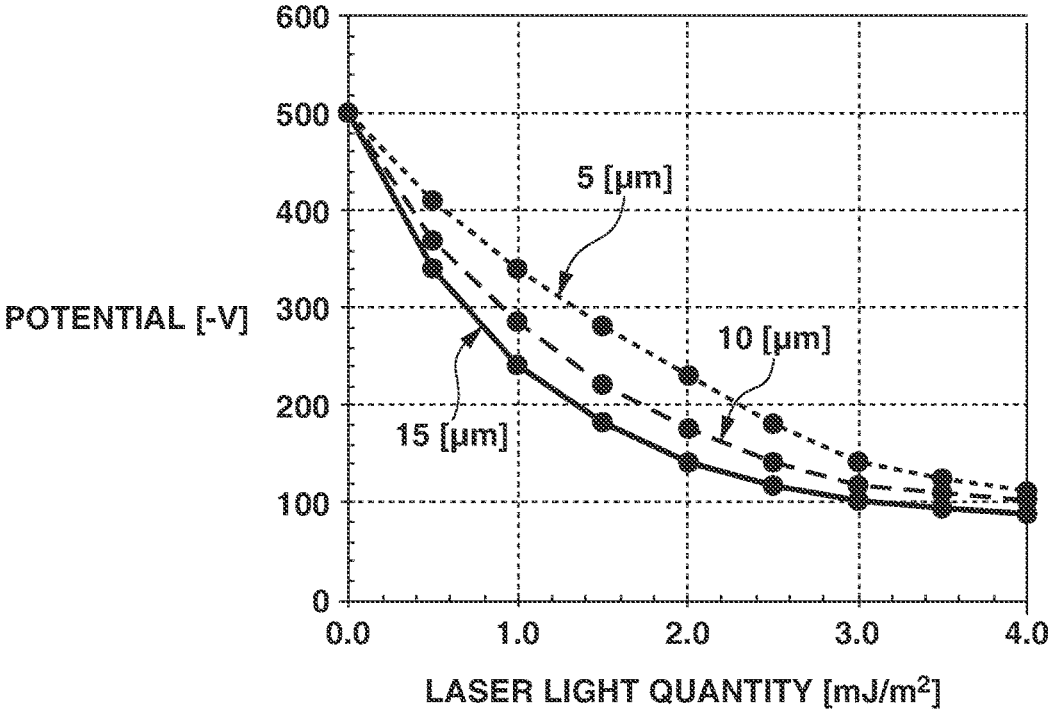
FIGS. 6A and 6B illustrate a relationship between gradation characteristics, exposure potential, and density.
Figure 6B:
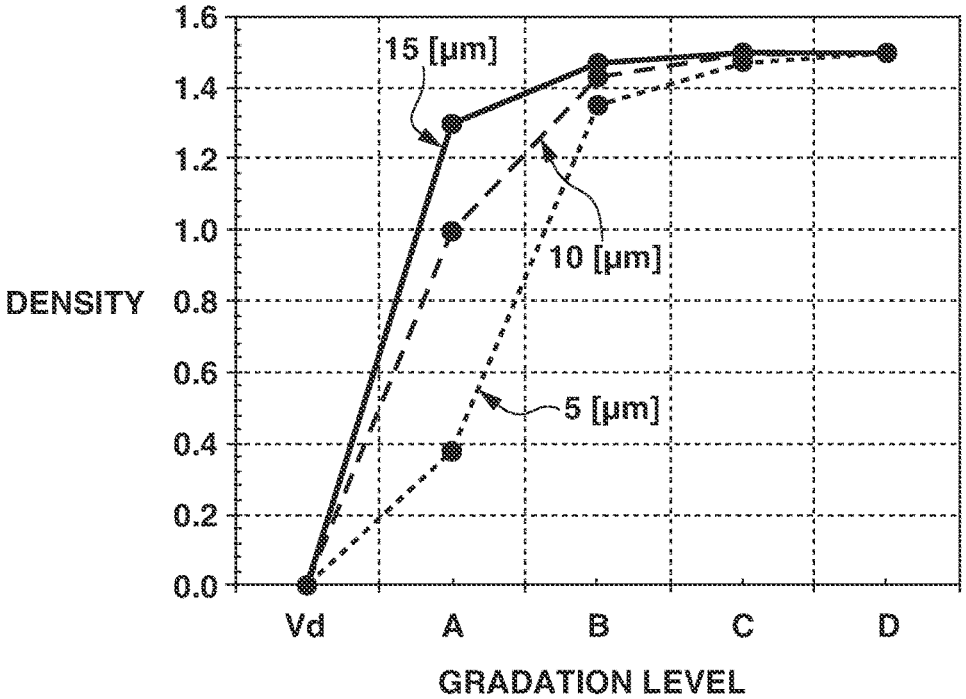

Results of gradation characteristic measurement will be described with reference to FIGS. 6A and 6B. The gradation characteristic measurement can be acquired by performing the above-described exposure potential measurement with a plurality of laser light quantities. In the measurement, a charging potential of −500 V is formed, and exposure is performed with each of nine laser light quantities from 0.0 mJ/m$^2$ increased by 0.5 mJ/m$^2$ up to 4.0 mJ/m$^2$ in addition to 3.0 mJ/m$^2$. Further, three film thicknesses of the photosensitive member are used that are 15 μm, 10 μm, and 5 μm. Results are illustrated in FIG. 6A. It is understood that the laser light quantity and the exposure potential change non-linearly. Further, different trends are exhibited depending on the film thickness. Further, an effect of the film thickness of the photosensitive member varies depending on the level of laser light quantity. In a case of a large laser light quantity, the fluctuation range of the exposure potential due to a change in the film thickness of the photosensitive member is relatively small. On the other hand, in a case of a small laser light quantity, the fluctuation range of exposure potential due to a change in the film thickness of the photosensitive member is large.

Further, the gradation characteristic, exposure potential, and image density have a correlation as illustrated in FIG. 4, and representing values of density with respect to the respective laser light quantities and the respective film thicknesses of the photosensitive member are checked. Results are illustrated in FIG. 6B. Further, the respective laser light quantities are for reproduction of gradations, so the cases of laser light quantities of 1.0 mJ/m$^2$, 2.0 mJ/m$^2$, 3.0 mJ/m$^2$, and 4.0 mJ/m$^2$ will be referred to as gradation levels A, B, C, and D, respectively. Further, the gradation level C of 3.0 mJ/m$^2$ is a pattern corresponding to a solid black density in the present example embodiment. As illustrated in FIG. 6B, especially the case of the film thickness of 5 μm of the photosensitive member in the gradation level A of the laser light quantity of 1.0 mJ/m$^2$ exhibits a significant change in density compared to the others. Further, the case of the film thickness of 10 μm of the photosensitive member also exhibits a decrease in density in the gradation level A of the laser light quantity of 1.0 mJ/m$^2$. Further, in the case of the gradation level C (solid black) of the laser light quantity of 3.0 mJ/m$^2$, no significant change in density is exhibited. Accordingly, in a case in which, for example, rich gradation characteristics are set with respect to the film thickness of 15 μm of the photosensitive member, a change in exposure potential which arises from a change in film thickness has substantially no effect on images of the solid black density and the like but causes a significant density change in halftones such as the gradation levels A and B. As a result, a change in appearance of a halftone image occurs. In view of the above-described results, tests are performed with target surface potentials of the photosensitive member of the gradation levels A, B, and C set to −240 V, −140 V, and −100 V, respectively, in the present example embodiment.

<Correction of Gradations>

A gradation correction method based on gradation characteristics acquired by a latent image potential measurement unit will be described. As illustrated in FIGS. 6A and 6B, the gradation characteristics change with a change in film thickness of the photosensitive member. In many conventional density correction methods, correction to keep the development contrast constant is performed by changing the development bias, etc. However, as described above, the change range with respect to a fluctuation in film thickness varies depending on the laser light quantity. Thus, for example, if the development contrast is corrected according to the solid black density of a large laser light quantity, it becomes difficult to obtain a correction density corresponding to a change in film thickness of the photosensitive member in a halftone pattern with a small laser light quantity.

Thus, in the present example embodiment, correction is performed with changed laser light quantities. For example, when the film thickness of the photosensitive member is changed from 15 μm to 5 μm, the range of change in exposure potential differs for each laser light quantity. Thus, the exposure potentials in the gradation levels A, B, and C (respective gradation levels) in the case of the film thickness of 15 μm are set as reference values (target potentials) of the exposure potentials in the respective gradation levels. Then, the laser light quantities corresponding to the respective gradation levels are corrected in such a manner that the exposure potentials in the respective gradation levels during exposure are adjusted to the target potentials in the cases of the film thicknesses other than the case of the film thickness of 15 μm. Specifically, from FIG. 6A, in the case of the gradation level A of the laser light quantity of 1.0 mJ/m$^2$, the laser light quantity of the gradation level A of the case of the film thickness of 5 μm is adjusted to about 1.8 mJ/m$^2$ so that the exposure potentials of the cases of the film thicknesses of 15 μm and 5 μm of the photosensitive member are equal, i.e., the exposure potential of the film thickness of 5 μm is adjusted to a target potential of −240 V, which is the potential of the case of the film thickness of 15 μm. Similarly, the laser light quantity is adjusted to 3.0 mJ/m$^2$ in the case of the gradation level B of the laser light quantity of 2.0 mJ/m$^2$, or to 4.0 mJ/m$^2$ in the case of the gradation level C of the laser light quantity of 3.0 mJ/m$^2$. Results are illustrated in FIG. 7.

Figure 7:
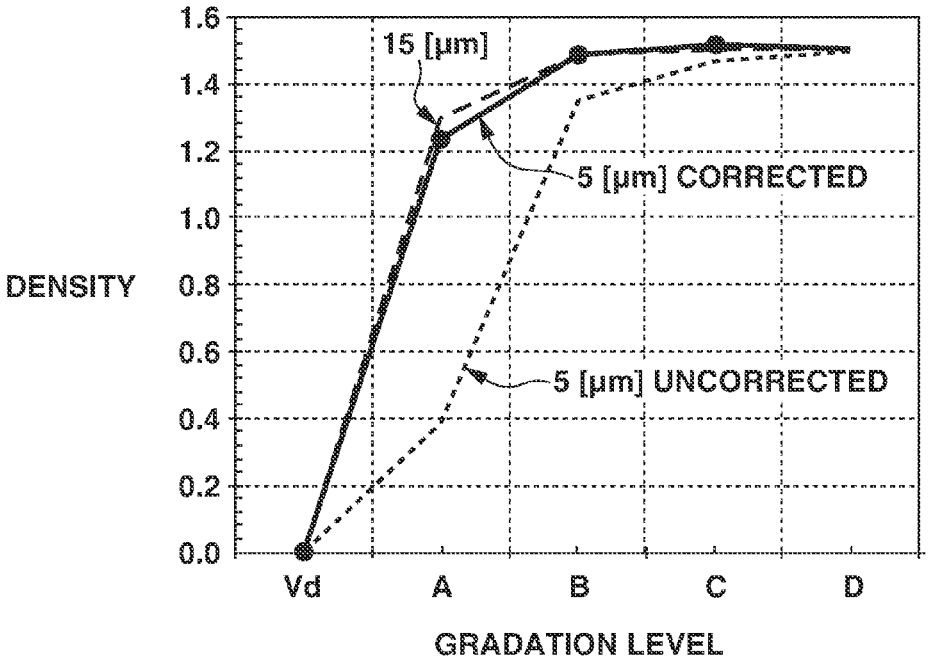
FIG. 7 illustrates an effect of gradation correction according to the first example embodiment of the present invention.

FIG. 7 illustrates effects of correction of gradations by correcting the laser light quantities in the present example embodiment. In FIG. 7, a solid line indicates a result of correction of the laser light quantities in the present example embodiment. Further, a broken line indicates a gradation characteristic of the case of the film thickness of 15 μm, and a dotted line indicates a gradation characteristic of the case of the film thickness of 5 μm with uncorrected laser light quantities. As illustrated in FIG. 7, densities obtained in the respective gradation levels are adjusted to be substantially equal as a result of the correction of the laser light quantities.

Modified Example

Figure 8:
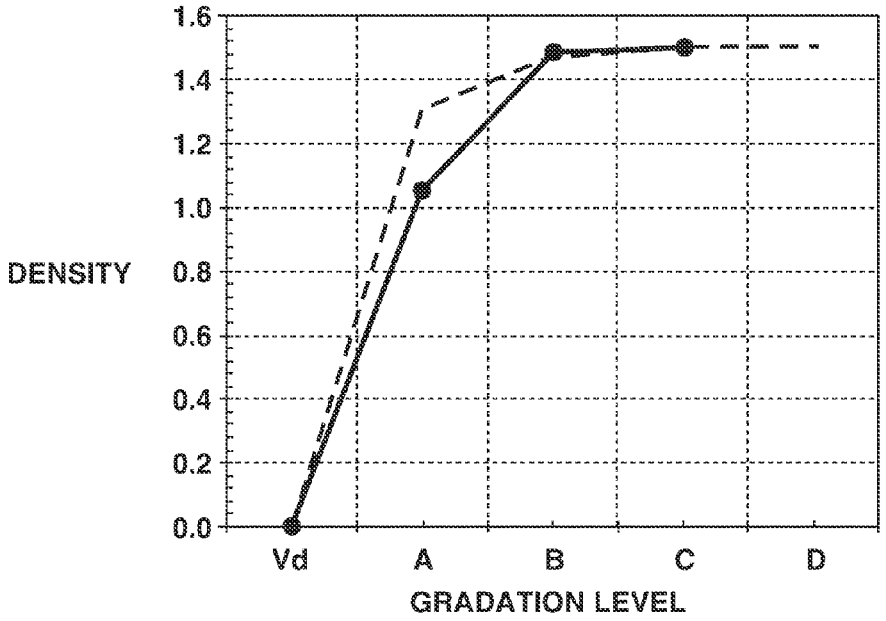
FIG. 8 illustrates an effect of gradation correction according to a modified example of the first example embodiment of the present invention.

FIG. 8 illustrates effects of correction of gradations by correcting the laser light quantities in a modified example of the present example embodiment. As described above, while it is definitely effective to correct individual measurement points, for example, a change rate of points measured with a plurality of laser light quantities may be calculated. When the film thickness of the photosensitive member is changed from 15 μm to 5 μm, the potential is changed from 240 V to 340 V in the case of the laser light quantity of 1.0 mJ/m$^2$. At this time, the rate of change is 240/340=70.6%. Similarly, the rates of change of the cases of 2.0 mJ/m$^2$, 3.0 mJ/m$^2$, and 4.0 mJ/m$^2$ are calculated, and results are 60.9%, 71.4%, and 81.5%, respectively. The laser light quantity is changed using the highest change rate of 60.9% to obtain 1.64 mJ/m$^2$ in the case of 1.0 mJ/m$^2$. Similar calculations are performed to check the exposure potentials with respect to the laser light quantities, and results are as illustrated in FIG. 8. Specifically, compared to the case of correcting individually, the correction with respect to the gradation level A is insufficient but improved compared to the case of the film thickness of 5 μm with uncorrected laser light quantities in FIG. 6B. Further, it is confirmed that a change in appearance of halftones was small.

As described above, an image corrected using any one of the above-described correction methods is unaffected by the film thickness of the photosensitive member, and it is confirmed that a halftone image which is unaffected by the film thickness of the photosensitive member is obtained.

<Flow of Image Forming>

Figure 1:
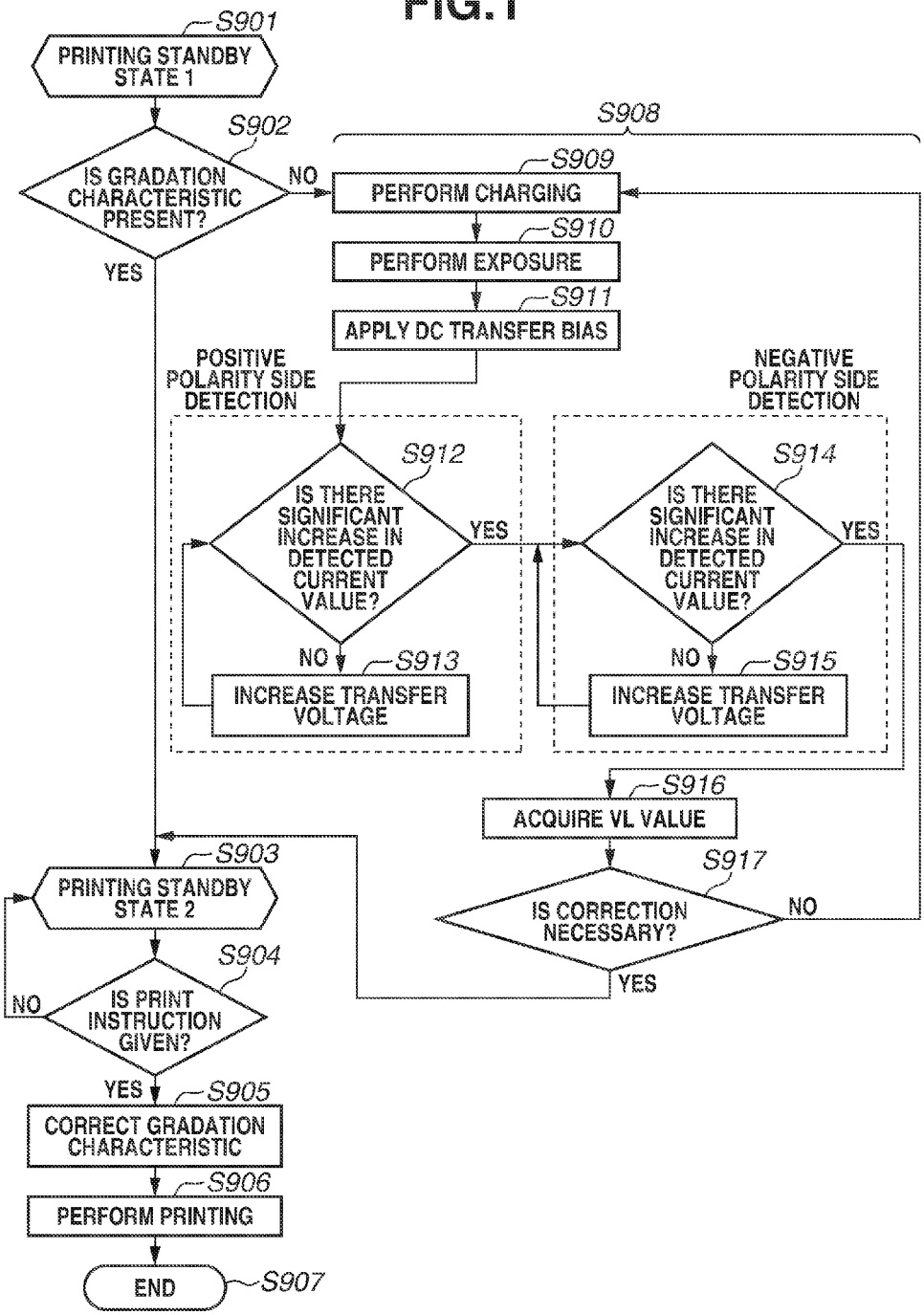
FIG. 1 is a flow chart illustrating an image forming operation according to a first example embodiment of the present invention.

A flow of a printing operation (image forming operation) according to the present example embodiment will be described below with reference to FIG. 1. FIG. 1 is a flow chart illustrating the printing operation according to the present example embodiment. The flow is executed by the electric equipment unit 214 as a control unit of the image forming apparatus.

In step S901, after the image forming apparatus is turned on, an initial sequence is performed so that the image forming apparatus becomes capable of performing printing and that the image forming apparatus is in a printing standby state 1. Then, in step S902, whether a gradation characteristic is present, i.e., whether the electric equipment unit 214 already acquires a gradation characteristic (whether a gradation characteristic is stored in a storage unit such as a memory included in the electric equipment unit 214), is checked. If a gradation characteristic is present (YES in step S902), i.e., if the electric equipment unit 214 already acquires a gradation characteristic, the processing proceeds to step S903. Then in step S903, the state of the image forming apparatus is changed to a printing standby state 2, and in step S904, a print instruction is awaited. If a print instruction is given (YES in step S904), i.e., if a print instruction is transmitted to the electric equipment unit 214 in response to user input, etc., then in step S905, the electric equipment unit 214 performs gradation characteristic correction according to the acquired gradation characteristic. In step S906, printing is performed based on a result of the correction. In step S907, the printing is ended. Then, in step S903, the state is changed to the printing standby state 2 again to await a print instruction.

On the other hand, in step S902, if it is determined that no gradation characteristic is acquired (NO in step S902), then in step S908, a gradation characteristic acquisition sequence is performed. In the determination of the presence or absence of a gradation characteristic in step S902, even when data on an acquired gradation characteristic is present, the processing can proceed to step S908 (the gradation characteristic acquisition sequence) if a predetermined condition is satisfied. Examples of the predetermined condition include a case in which a time has passed since a previous acquisition timing, a case in which printing is performed a plurality of times (cumulated number of image forming operations), and a case in which the layer thickness of the photosensitive member 201 is changed by a predetermined amount or more. At this time, whether the layer thickness of the photosensitive member 201 is significantly changed by a predetermined amount or more is determined by calculating an amount of change in layer thickness of the photosensitive member 201 from the previous acquisition timing based on the cumulated number of rotations of the photosensitive member 201, etc. and then determining whether the amount of change is not less than a predetermined threshold value. In step S909, the photosensitive member 201 is uniformly charged. In step S910, exposure is performed to detect a gradation characteristic. In step S910, first, exposure is performed with a value of 3.0 mJ/m$^2$ in the present example embodiment. In step S911, after an exposure potential is formed, a transfer bias of a predetermined DC value is applied. At this time, a transfer bias of a DC value in the vicinity of a value that is expected as the exposure potential is applied. In the present example embodiment, the transfer bias is about −100 V. After the application of the transfer DC value, a transfer current value is monitored, and the transfer voltage is increased toward the positive polarity side. In the present example embodiment, the transfer voltage is sequentially increased by 50 V to −50 V, 0 V, 50 V, . . . with respect to −100 V. In step S912, whether there is a significant increase in a detected current value, i.e., whether a discharge current occurs, is checked. If there is a significant increase (YES in step S912), the transfer DC value at this point (inflection point) is determined as a discharge start voltage (Vt+) of the positive polarity side. Then, the above-described operation is performed with respect to the negative polarity side. In step S914, whether there is a change in current value is checked. If there is not any significant increase (NO in step S914), then in step S915, the transfer DC value is increased toward the negative polarity side. If there is a significant increase in current value (YES in step S914), the transfer DC value is determined as a discharge start voltage (Vt−) of the negative polarity side. In step S916, a center value between the discharge start voltage (Vt+) of the positive polarity side and the discharge start voltage (Vt−) of the negative polarity side is acquired as a voltage (VL) value of the laser light quantity of 3.0 mJ/m$^2$.

Similarly, gradation characteristics (VL values corresponding to actual exposure potentials) with respect to the plurality of gradation levels (1.0 mJ/m$^2$, 2.0 mJ/m$^2$, 4.0 mJ/m$^2$) are acquired, and whether correction is necessary is determined in step S917. If it is determined that correction is necessary (YES in step S917), correction values for the laser light quantities in the respective gradation levels are determined in such a manner that actual exposure potentials in the respective gradation levels (gradation levels A, B, and C) are adjusted to the target potentials. Each of the correction values is determined based on a difference between the acquired VL value and the target potential. More specifically, a lookup table in which the "difference between the acquired VL value and the target potential" and "correction value" are associated is stored in advance, the correction values are determined based on the lookup table. The determined correction value is stored in a storage unit (not illustrated). Thereafter, in step S903, the state is changed to the printing standby state 2, and in step S904, a print instruction is awaited. If a print instruction is received, as described above, the laser light quantities of the respective gradation levels are corrected according to the correction value stored in the storage unit to obtain an image with a suitable gradation representation.

The method of determining the correction values is not limited to the above-described method in which the lookup table is referenced. Specifically, the correction values can be calculated by performing a computation based on the acquired VL value and the target potential.

Advantage of Present Example Embodiment

As described above, as the film thickness of the photosensitive member is changed, the exposure potential exhibits a change corresponding to the laser light quantity. Thus, suitable correction for each laser light quantity is performed to correct the gradation characteristic so that a stable image in which gradations are maintained is obtained even in the case in which the film thickness is changed.

While the laser light quantities in the range of 1.0 mJ/m$^2$ to 4.0 mJ/m$^2$ are used in the present example embodiment, the range is not limited to the above-described range, because an optimum value varies depending on conditions such as a characteristic and rotation speed of the photosensitive member. Further, the number of points of gradation characteristic detection is four in the above description. As described above, the relationship between the laser light quantity and the exposure potential is not a linear change but a non-linear change. To correct a non-linear change, it is considered that three or more points are needed. However, the number of points needed is not limited to three or more. Further, while the exposure potential measurement is performed using the transfer roller, the exposure potential measurement is not limited to the above-described exposure potential measurement. Specifically, the exposure potential measurement can be performed using a conductive member capable of coming into contact with the photosensitive member to apply a bias and measuring a current value along with the application of the bias.

Further, the gradation characteristic measurement in the present example embodiment is performed using a detection technique in which a current value of current flowing in response to the application of DC bias is acquired and a point at which an inflection point occurs is detected as a discharge start voltage. Similar results are also obtained using a differential discharge current detection technique in which an AC waveform is applied and discharging is performed to cause a distortion in the applied waveform and a discharge start voltage is detected based on the distortion.

While the AC bias arrangement in which the charging potential is constant is described in the present example embodiment, the arrangement is not limited to the AC bias arrangement. In a DC charging arrangement in which a DC bias is applied, a charging potential is changed according to the film thickness of a photosensitive member. Further, as the charging potential is changed, the exposure potential also changes. However, the technical content described in the present example embodiment does not change. Even if the charging potential is changed, the exposure potentials are corrected and the gradation characteristics including the development contrast are adjusted to be equal to obtain similar effects. Further, in the DC charging arrangement, a change in charging potential also becomes measurable, so charging potential stabilization and gradation characteristic correction are realized also in the DC charging arrangement.

Further, in the present example embodiment, the exposure potential measurement is described in which the transfer DC value is changed toward both the positive polarity side and the negative polarity side using an expected exposure potential as a reference to detect discharge start voltages of the respective sides, and an intermediate value between the detected discharge start voltages is determined as a VL value. The VL value obtained from the results of measurement at both polarities is accurate also in terms of its absolute value, so an effect of a slight change in the discharge start voltages which arises from an environment or the film thickness of the photosensitive member is prevented. However, the measurement is not limited to the above-described measurement, and as long as an accurate value is obtained for at least one point, detection results of similar accuracy are obtained for other measurement points by correcting an amount of detection deviation and the like based on the accurate value. Further, as to a method of obtaining an accurate value for at least one point, an accurate value can be estimated from use history information and the like as in conventional methods, and as described in the present example embodiment, gradation characteristics are acquired and corrected to produce an advantage.

Further, in the present example embodiment, correction is performed according to the gradation characteristic of the case of the film thickness of 15 μm of the photosensitive member. However, suitable control of gradation characteristics for various use environments or use states can be realized as in the present example embodiment by storing gradation characteristics in the apparatus main body and referencing the stored gradation characteristics to perform control according to the gradation characteristics regardless of whether the photosensitive member is in an initial state after a start of use or the photosensitive member is being used. Further, correction to increase the laser light quantities is described above. However, in a case in which, for example, a reference gradation characteristic is set with respect to the film thickness of 10 μm of the photosensitive member, correction to reduce the laser light quantities can be performed with respect to a thicker film thickness of the photosensitive member such as 15 μm, and a similar advantage is also produced. Further, changing an energy based on a cumulated irradiation time, such as a laser lighting time, with respect to one dot as well as changing an energy (luminance of emitted laser light) of a laser light quantity are both effective methods in correcting the laser light quantity. Further, controlling an energy applied to the photosensitive member in more detail using a laser light quantity and irradiation time in combination also produces an advantage described in the present example embodiment.

The following describes a second example embodiment of the present invention. Description of points that are similar to those in the first example embodiment is omitted in the present example embodiment. Unless otherwise specified, points that are not described in the second example embodiment are similar to those in the first example embodiment. In the first example embodiment, a change in gradation characteristics which arises from a change in exposure potential due to a fluctuation in film thickness of the photosensitive member is detected and corrected using the exposure potential measurement technique to obtain a stable image. A change in gradation characteristics arises not only from a fluctuation in film thickness of the photosensitive member but also a change in an environment in which the apparatus is situated. In the second example embodiment, a temperature/humidity sensor 216 (temperature/humidity detection unit) configured to detect a temperature and humidity (refer to FIG. 2) is used as a unit for detecting an environmental condition of the environment in which the apparatus is situated. In the present example embodiment, a change in gradation characteristics which originates from a change in the environment in which the apparatus is situated is detected and corrected using an exposure potential measurement technique to obtain a stable image.

Figure 10A:
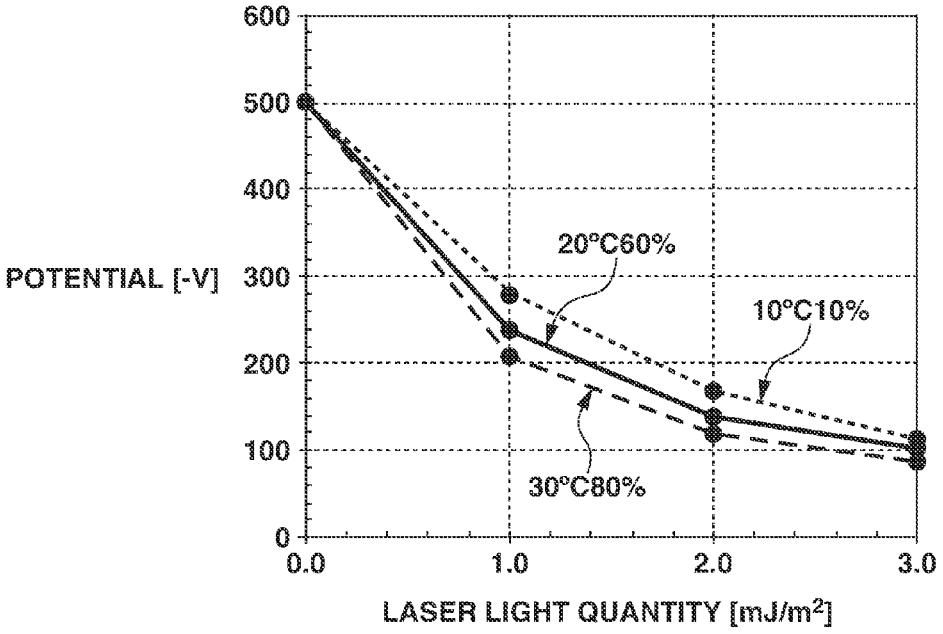
FIGS. 10A and 10B illustrate changes in gradation characteristics due to environmental changes according to a second example embodiment of the present invention.
Figure 10B:
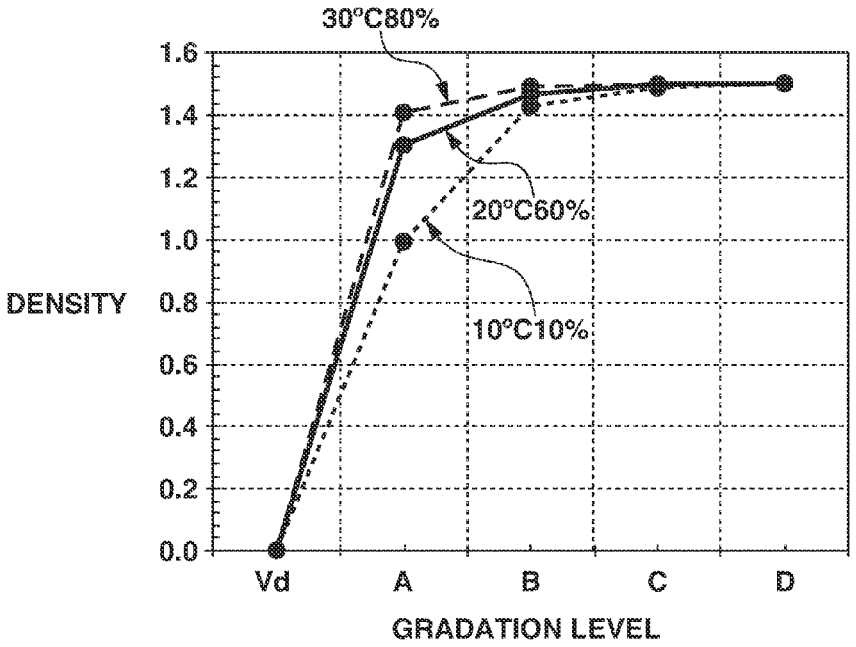

A change in gradation characteristics due to an environmental change will be described with reference to FIGS. 10A and 10B. FIG. 10A illustrates changes in gradation characteristics which originate from an environmental change (change in temperature/humidity) in the case of the film thickness of 15 μm of the photosensitive member. As illustrated in FIG. 10A, measurements of the first example embodiment are results obtained under environmental conditions of 20 degrees Celsius and 60%. On the other hand, a broken line indicates measurements under environmental conditions of 10 degrees Celsius and 10%, and a dotted line indicates measurements under environmental conditions of 30 degrees Celsius and 80%. As illustrated in FIG. 10A, a change in temperature/humidity causes a change which is smaller than that in the first example embodiment but has a different range of change in exposure potential with respect to a change in laser light quantities, because the sensitivity of the photosensitive member with respect to the laser light quantity is changed by the temperature/humidity. Further, density characteristics in the respective gradation levels are as illustrated in FIG. 10B. As illustrated in FIG. 10B, densities under the environment of 10 degrees Celsius and 10% are decreased in the gradation level A, compared to the environment of 20 degrees Celsius and 60% according to the first example embodiment. The appearance of a halftone image or the like is changed to give an impression that the image is pale. Similarly, densities under the environmental conditions of 30 degrees Celsius and 80% are increased in the gradation level A to give an impression that the image is globally dark. This is probably due to a change in sensitivity of the photosensitive member with respect to laser light quantities by the temperature/humidity.

Figure 11:
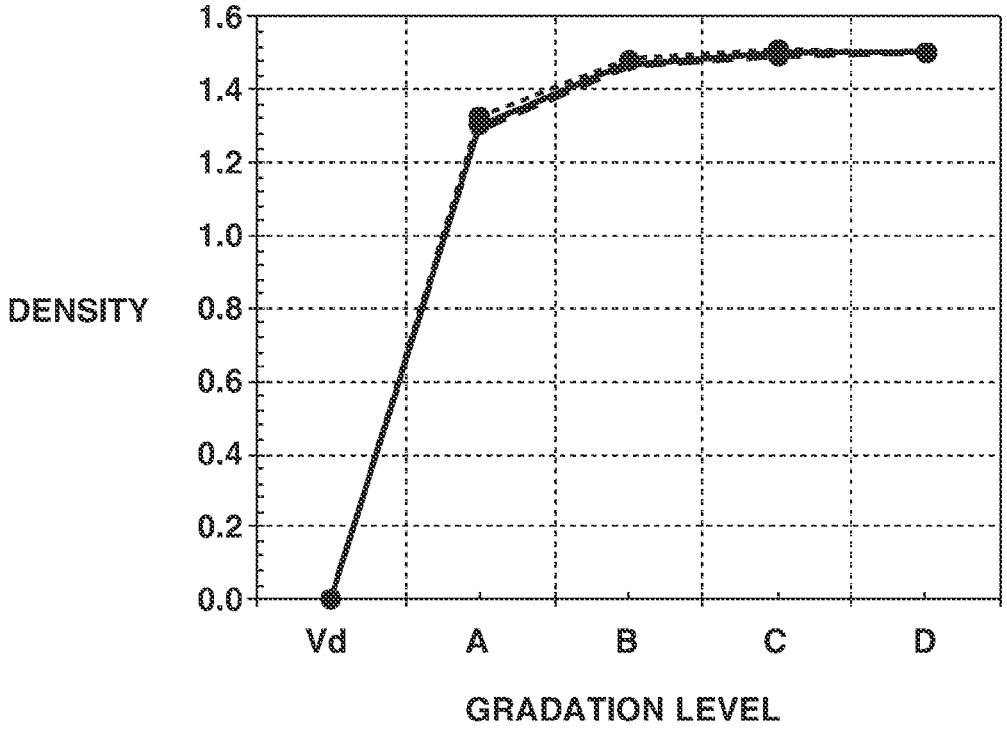
FIG. 11 illustrates an effect according to the second example embodiment of the present invention.

Thus, as described above in the first example embodiment, gradation characteristics are measured and corrected also in the present example embodiment. From FIG. 10A, correction under the environment of 10 degrees Celsius and 10% is performed to decrease the laser light quantity, and correction under the environment of 30 degrees Celsius and 80% is performed to increase the laser light quantity. It is also confirmed that a change in image quality including halftones is also prevented in the case of an environmental change by correcting gradation characteristics. Results are illustrated in FIG. 11. As illustrated in FIG. 11, gradation characteristics under the environment of 10 degrees Celsius and 10% and the environment of 30 degrees Celsius and 80% both substantially match the gradation characteristic under the environment of 20 degrees Celsius and 60%. Further, the appearance of a halftone image is corrected as appropriate based on the results to obtain equivalent image quality.

A flow according to the present example embodiment is similar to the flow described in the first example embodiment with reference to FIG. 1, description of the flow is omitted. In the present example embodiment, a condition described below can be added following the determination of the presence or absence of a gradation characteristic in step S902 in the flow described above with reference to FIG. 1. Specifically, the processing is to proceed from step S902 to step S908 (the gradation characteristic acquisition sequence) even if data on an acquired gradation characteristic is present or if an environment is changed by a predetermined level or higher since a previous acquisition timing. More specifically, a sensor configured to detect environmental conditions (temperature, humidity, absolute moisture content, etc.) may be provided, and if an amount of change in sensor output from the previous acquisition timing is not less than a predetermined threshold value, it is determined that the environment is changed by the predetermined level or higher from the previous acquisition timing. As described in the present example embodiment, a change in a use environment causes a change in sensitivity of the photosensitive member. If VL detection is performed on the change through discharge start voltage detection or the like as described above, stable image quality is obtained regardless of the environment in which the apparatus is situated. While a first temperature and humidity as a control reference of the present example embodiment are set to 20 degrees Celsius and 60% in the present example embodiment, the first temperature and humidity are not limited to 20 degrees Celsius and 60%. Further, a second temperature and humidity which are lower than the first temperature and humidity as representative values of a low-temperature, low-humidity environment are set to 10 degrees Celsius and 10% in the present example embodiment, the second temperature and humidity are not limited to 10 degrees Celsius and 10%. Similarly, the second temperature and humidity which are higher than the first temperature and humidity as representative values of a high-temperature, high-humidity environment are set to 30 degrees Celsius and 80% in the present example embodiment, the second temperature and humidity are not limited to 30 degrees Celsius and 80%.

The following describes a third example embodiment of the present invention. Description of points that are similar to those in the first and second example embodiments is omitted in the present example embodiment. Unless otherwise specified, points that are not described in the third example embodiment are similar to those in the first and second example embodiments. In the first example embodiment, correcting laser light quantities is described as an effective method for correcting gradation characteristics. Specifically, a light quantity with respect to one dot included in an image is changed by changing an output level of a light source of the exposure unit with respect to the one dot. In the present example embodiment, dither patterns for changing an exposure image pattern per unit area are used as a method of correcting gradation characteristics. Specifically, while an output level of the light source of the exposure unit is kept constant, a dot pattern forming a predetermined unit region of an image to be formed is changed to change the light quantity with respect to the unit region. This arrangement also produces a similar advantage to those produced in the first and second example embodiments.

First, the dither patterns will be described. In the present example embodiment, an image resolution of 600 dpi to form 600 dots per inch is used. The dither patterns are used to control exposure potentials by, for example, changing a percentage of lit pixels among 16 dots using a set of pixels of 4 dots×4 dots as one image unit. For example, in a case of lighting all 16 dots of 4 dots×4 dots of the laser light quantity of 3.0 mJ/m$^2$, the same latent image potential as the light quantity of 3.0 mJ/m$^2$ of the case of lighting all 16 dots is obtained in the 4 dot×4 dot range. On the other hand, in a case of lighting 4 dots, 4 out of 16 dots are lit, so an exposure potential corresponding to 0.75 mJ/m$^2$ which is 25% is obtained.

Figure 12:
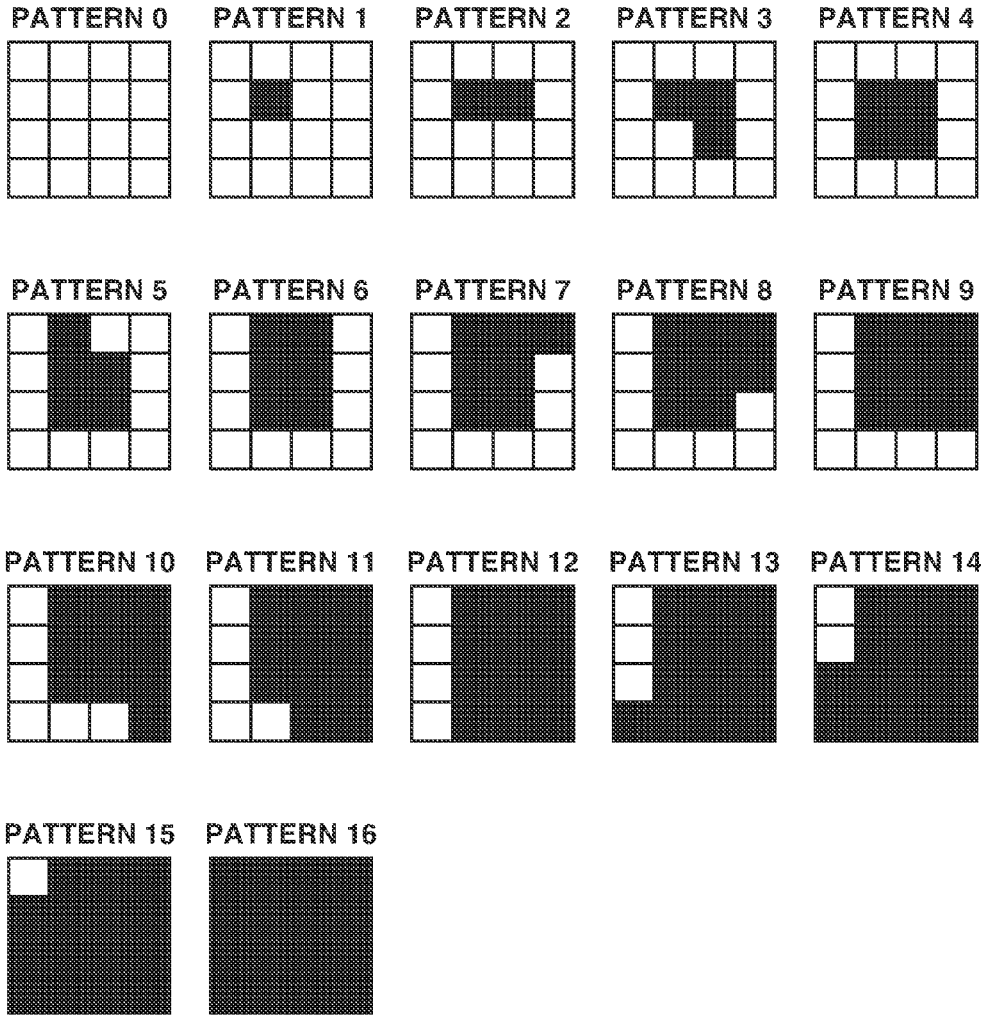
FIG. 12 illustrates dither patterns according to a third example embodiment of the present invention.

The present example embodiment is described based on the foregoing. Further, the dither patterns are as illustrated in FIG. 12. Further, the laser light quantity is set to a fixed value of 5.0 mJ/m$^2$, and values of exposure potentials of the respective dither patterns are as specified in FIG. 13. Light quantity values calculated from coverage are also specified. Further, it is confirmed that the exposure potential matches an exposure potential obtained from an actual light quantity at that time. As described above, the laser light quantity (mJ/m$^2$) is changed in the first example embodiment to change the exposure amount per unit area of the surface of the photosensitive member 201. On the other hand, in the present example embodiment, while the laser light quantity (mJ/m$^2$) is kept constant, the dither patterns are changed to change the exposure amount per unit area (e.g., 600 dpi, 4 dot×4 dot region) of the surface of the photosensitive member 201.

As in the above described example embodiments, a pattern 10 is selected from FIG. 13 as a dither pattern of the film thickness of 15 μm of the photosensitive member a dither pattern for obtaining a surface potential of −100 V of the photosensitive member in the gradation level C. Similarly, dither patterns for obtaining the surface potential of the photosensitive member in the gradation levels A and B are also selected from FIG. 13. Next, a necessary laser light quantity for obtaining an exposure potential of −100 V in the gradation level C in the case of the film thickness of 5 μm of the photosensitive member is 4.0 mJ/m$^2$, so a pattern 13 in FIG. 13 is selected as a dither pattern. Similarly, dither patterns for the other gradation levels are selected so as to obtain a target exposure potential.

Figure 15:
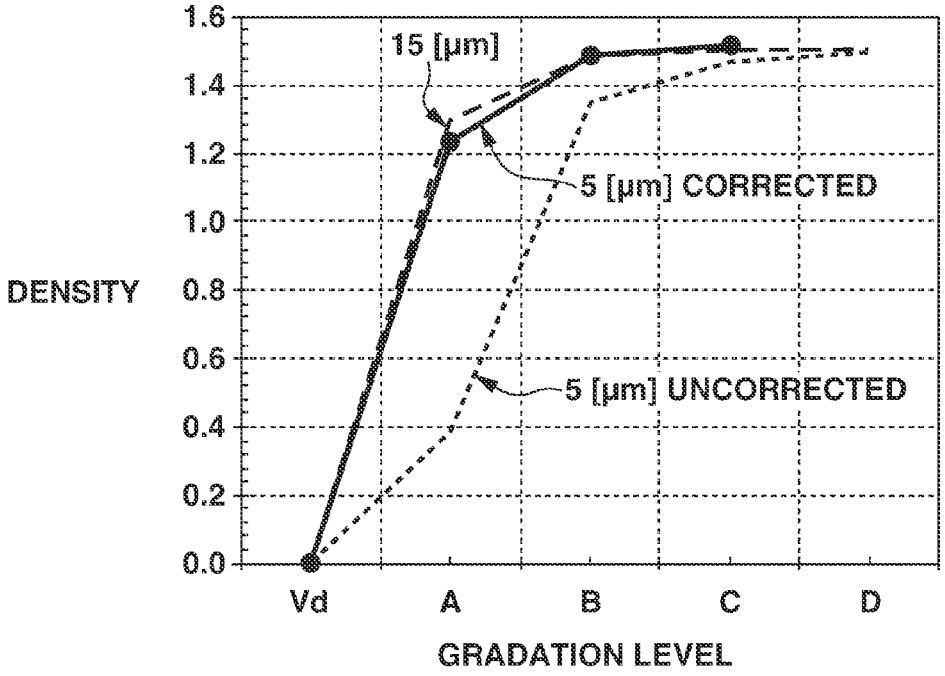
FIG. 15 illustrates an effect according to the third example embodiment of the present invention.

The dither patterns are selected in such a manner that the exposure potentials corresponding to the respective gradation levels become equal regardless of the film thickness of the photosensitive member, and images of the cases in which the film thickness of the photosensitive member is 15 μm and 5 μm are compared. As a result of detection of gradation characteristics of the photosensitive member, it is found that an optimum dither pattern for the respective gradation levels with respect to the film thicknesses of 15 μm and 5 μm of the photosensitive member is a dither pattern illustrated in FIG. 14. Densities in the case of the dither pattern illustrated in FIG. 14 are as illustrated in FIG. 15. As illustrated in FIG. 15, selecting a suitable dither pattern for the film thickness of the photosensitive member makes it possible to correct the gradation characteristics. Further, halftone images are also compared, and it is confirmed that stable images with fewer density changes are obtained.

Figure 16:
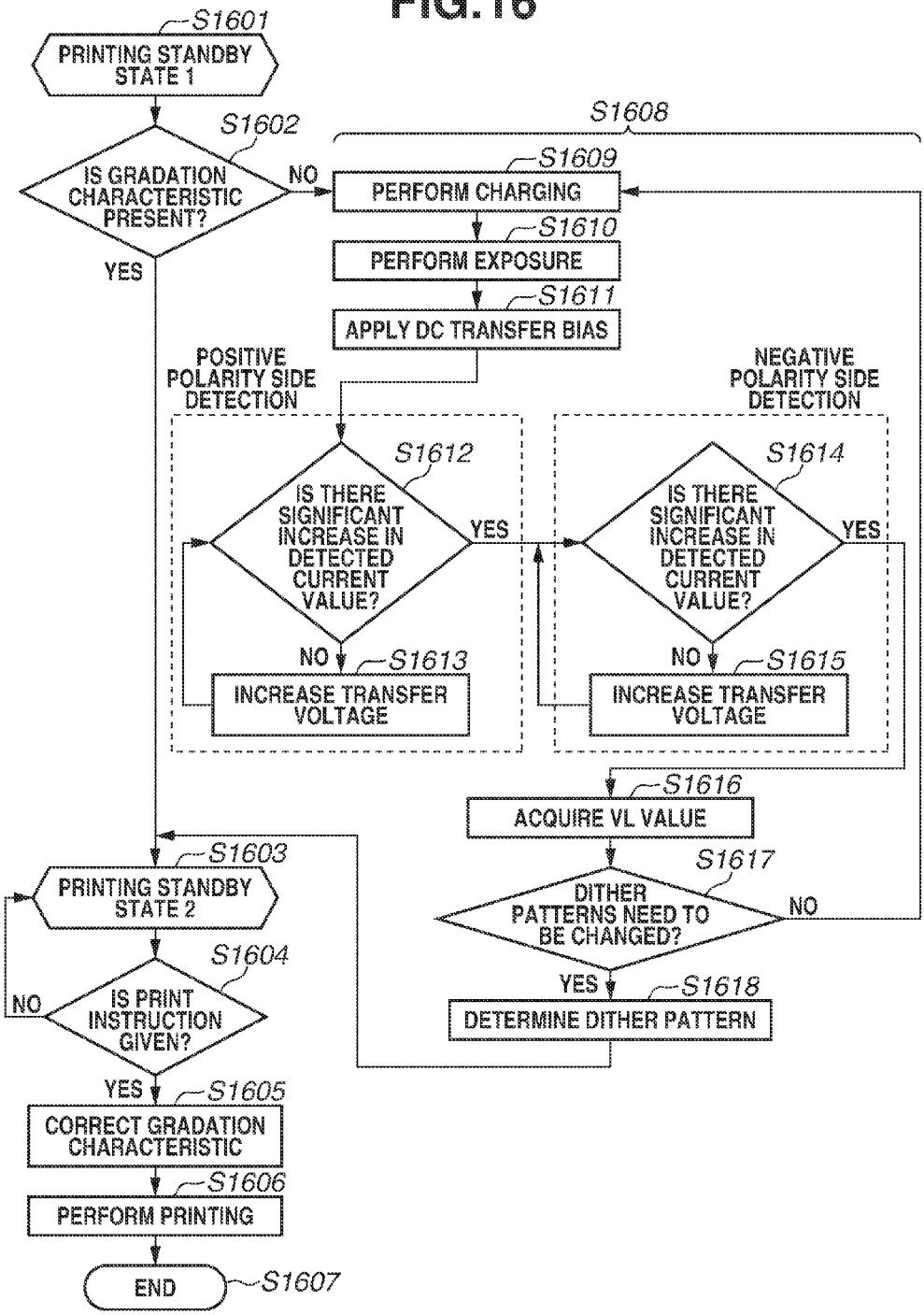
FIG. 16 is a flow chart illustrating an image forming operation according to the third example embodiment of the present invention.

A flow according to the present example embodiment will be described below with reference to FIG. 16. In step S1601, after the image forming apparatus is turned on, the initial sequence is performed so that the image forming apparatus becomes capable of performing printing and that the image forming apparatus is in the printing standby state 1. Then, in step S1602, whether a gradation characteristic is present, i.e., whether the electric equipment unit 214 already acquires a gradation characteristic (whether a gradation characteristic is stored in a storage unit such as a memory included in the electric equipment unit 214), is checked. If a gradation characteristic is present (YES in step S1602), the processing proceeds to step S1603. Then in step S1603, the state of the image forming apparatus is changed to the printing standby state 2, and in step S1604, a print instruction is awaited. If a print instruction is given (YES in step S1604), then in step S1605, gradation characteristic correction is performed according to the acquired gradation characteristic. In step S1606, printing is performed based on a result of the correction. In step S1607, the printing is ended. Then, in step S1603, the state is changed to the printing standby state 2 again to await a print instruction.

On the other hand, in step S1602, if it is determined that no gradation characteristic is acquired (NO in step S1602), the processing proceeds from step S1602 to step S1608, and a gradation characteristic acquisition sequence is performed. In the determination of the presence or absence of a gradation characteristic in step S1602, even when data on an acquired gradation characteristic is present, the processing can proceed to step S1608 (the gradation characteristic acquisition sequence) if a time has passed since a previous acquisition timing, if printing is performed a plurality of times, if the layer thickness of the photosensitive member 201 is changed by a predetermined amount or more, or if the environment is changed by a predetermined level or more. At this time, whether the layer thickness of the photosensitive member 201 is significantly changed by the predetermined amount or more is determined by calculating the amount of change in layer thickness of the photosensitive member 201 from the previous acquisition timing based on the cumulated number of rotations of the photosensitive member 201, etc. and then determining whether the amount of change is not less than the predetermined threshold value. As to the determination of whether the environment is changed by the predetermined level or more, a sensor configured to detect environmental conditions (temperature, humidity, absolute moisture content, etc.) is provided, and if the amount of change in sensor output from the previous acquisition timing is not less than the predetermined threshold value, it is determined that the environment is changed by the predetermined level or more. In step S1609, the photosensitive member 201 is uniformly charged. In step S1610, exposure is performed to detect a gradation characteristic. In step S1610, first, a dither pattern 10 is selected from FIG. 14 in the present example embodiment so that a light quantity of the gradation level C (corresponding to laser light quantity of 3.0 mJ/m$^2$) is output, and exposure is performed. In step S1611, after an exposure potential is formed, a transfer DC value is applied. At this time, a DC value in the vicinity of a value that is expected as the exposure potential is applied. In the present example embodiment, the DC value is about −100 V. After the application of the transfer DC value, the transfer current value is monitored, and the transfer voltage is increased toward the positive polarity side. In the present example embodiment, the transfer voltage is sequentially increased by 50 V to −50 V, 0 V, 50 V, . . . with respect to −100 V. In step S1612, whether there is a significant increase in a detected current value, i.e., whether a discharge current occurs, is checked. If there is a significant increase (YES in step S1612), then in step S1613, the transfer DC value at this point is determined as the discharge start voltage (Vt+) of the positive polarity side. Then, the above-described operation is performed with respect to the negative polarity side. In step S1614, whether there is a change in current value is checked. If there is not any significant increase (NO in step S1614), then in step S1615, the transfer DC value is increased toward the negative polarity side. The transfer DC value at the time point at which a significant increase in current values is detected (YES in step S1614) is determined as the discharge start voltage (Vt−) of the negative polarity side. In step S1616, a center value between the discharge start voltage (Vt+) of the positive polarity side and the discharge start voltage (Vt−) of the negative polarity side is acquired as a VL value in the dither pattern 10 of the gradation level C (corresponding to laser light quantity of 3.0 mJ/m$^2$).

Similarly, in step S1617, the above-described operation is performed with respect to a dither pattern 3 for the gradation level A (corresponding to laser light quantity of 1.0 mJ/m$^2$), a dither pattern 6 for the gradation level B (corresponding to laser light quantity of 2.0 mJ/m$^2$), and the dither pattern 13 for the gradation level D (corresponding to laser light quantity of 4.0 mJ/m$^2$), gradation characteristics are acquired, and whether the dither patterns are to be changed is determined. If it is determined that the dither patterns are to be changed (YES in step S1617), then in step S1618, dither patterns corresponding to the respective laser light quantities are determined, and the change is stored. A dither pattern to be selected as a changed dither pattern is determined based on a difference between the acquired VL value and the target potential. More specifically, a lookup table in which the "difference between the acquired VL value and the target potential" and "dither pattern correction value" are associated is stored in advance, and the dither pattern is changed based on the "dither pattern correction value" acquired from the lookup table. For example, in a case in which the current dither pattern for the gradation level A is the dither pattern 3 and a dither pattern correction value of "+2" is acquired in the above-described flow, the dither pattern for the gradation level A is changed from the dither pattern 3 to a dither pattern 5, which is 2 level higher than the dither pattern 3. Then, information indicating that the dither pattern for the gradation level A is the dither pattern 5 is stored in the storage unit (not illustrated). In step S1603, the state is changed to the printing standby state 2. In step S1604, a print instruction is awaited. When a print instruction is received, exposure is performed using the changed dither pattern so that an image with an appropriate gradation representation is obtained.

The arrangement in which a dot pattern forming a predetermined unit region of an image to be formed is changed as in the above-described example embodiments is not a limiting arrangement and, for example, an irradiation time may be changed while the output level of the light source of the exposure unit with respect to one dot included in an image is kept constant.

While the present invention has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-157878, filed Aug. 10, 2016, which is hereby incorporated by reference herein in its entirety.

What is claimed is:

1. An image forming apparatus comprising:

a photosensitive member having an electrical charge retention layer;

a charging member configured to electrically charge the photosensitive member;

an exposure unit configured to expose a surface of the electrical charge retention layer to form an electrostatic image on the surface;

a developing agent bearing member configured to supply a developing agent to the surface to develop the electrostatic image and form a developing agent image;

a measurement unit configured to measure an exposure potential of the photosensitive member based on a discharge start voltage; and a control unit configured to control a light quantity per unit area of the surface exposed by the exposure unit, wherein the developing agent image is transferred onto a recording material to form an image on the recording material, and wherein, based on a plurality of exposure potentials corresponding to a plurality of gradation levels which is acquired by exposing with the exposure unit the surface with each of a plurality of reference light quantities corresponding to the plurality of gradation levels, and measuring with the measurement unit the plurality of exposure potentials of the photosensitive member which is formed by the exposure with the plurality of reference light quantities, the control unit changes, to a light quantity different from the reference light quantities, the light quantity per unit area of the surface when the exposure unit exposes the surface in correspondence with the plurality of gradation levels.

2. The image forming apparatus according to claim 1, further comprising a transfer member configured to transfer the developing agent image from the photosensitive member onto the recording material in response to application of a bias, wherein the measurement unit measures a current flowing in the transfer member to acquire the discharge start voltage.

3. The image forming apparatus according to claim 1, wherein the control unit changes the light quantity in such a manner that the exposure potential acquired by the exposure with the changed light quantity becomes closer to a predetermined target potential than the exposure potentials acquired by the exposure with the reference light quantities.

4. The image forming apparatus according to claim 1, wherein the control unit determines, for each of the plurality of gradation levels, a quantity by which the light quantity is changed from the reference light quantities.

5. The image forming apparatus according to claim 4, wherein the control unit changes the light quantity using a lookup table in which predetermined target potentials, the exposure potentials acquired by the exposure with the reference light quantities, and the quantities by which the light quantity is changed from the plurality of reference light quantities are associated for the respective gradation levels.

6. The image forming apparatus according to claim 1, wherein the control unit changes the light quantity using a highest rate of change among rates of change between predetermined target potentials and the exposure potentials acquired by the exposure with the reference light quantities for the respective gradation levels.

7. The image forming apparatus according to claim 1, wherein the control unit changes the light quantity in a case where any one of an elapsed time since a previous change of the light quantity, a cumulated number of image forming operations, and a cumulated number of rotations of the photosensitive member is equal to or more than a predetermined threshold value.

8. The image forming apparatus according to claim 1, further comprising a temperature/humidity detection unit configured to detect a temperature and humidity, wherein the control unit changes the light quantity in a case where an amount of change in the temperature and humidity detected by the temperature/humidity detection unit is equal to or more than a predetermined threshold value.

9. The image forming apparatus according to claim 1, wherein the control unit changes a light quantity with respect to one dot included in the image by changing an output level of a light source of the exposure unit with respect to the one dot.

10. The image forming apparatus according to claim 1, wherein the control unit changes a light quantity with respect to one dot included in the image by changing an irradiation time of a light source of the exposure unit with respect to the one dot while an output level of the light source of the exposure unit with respect to the one dot is kept constant.

11. The image forming apparatus according to claim 1, wherein the control unit changes a light quantity with respect to a predetermined unit region of an image to be formed by changing a dot pattern forming the predetermined unit region while an output level of a light source of the exposure unit is kept constant.

* * * * *